US007389665B1

(12) United States Patent
Luckey, Jr. et al.

(10) Patent No.: US 7,389,665 B1
(45) Date of Patent: Jun. 24, 2008

(54) SHEET METAL FORMING PROCESS

(75) Inventors: S. George Luckey, Jr., Dearborn, MI (US); Peter A. Friedman, Ann Arbor, MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 11/565,061

(22) Filed: Nov. 30, 2006

(51) Int. Cl.
*B21D 26/02* (2006.01)

(52) U.S. Cl. ..... 72/60; 72/342.7; 72/350

(58) Field of Classification Search ..... 72/57, 72/60, 347, 342.7, 350, 351
See application file for complete search history.

(56) References Cited

U.S. PATENT DOCUMENTS

| | | | | |
|---|---|---|---|---|
| 3,340,101 | A | 9/1967 | Fields, Jr. et al. | |
| 3,975,936 | A | 8/1976 | Baldwin et al. | |
| 4,045,986 | A | 9/1977 | Laycock et al. | |
| 4,266,416 | A | 5/1981 | Festag et al. | |
| 4,901,552 | A | 2/1990 | Ginty et al. | |
| 4,936,128 | A | 6/1990 | Story et al. | |
| 5,647,239 | A | 7/1997 | Fischer | |
| 5,823,032 | A | 10/1998 | Fischer | |
| 5,916,316 | A | 6/1999 | Fischer | |
| 6,098,438 | A | 8/2000 | Fischer | |
| 6,253,588 | B1 | 7/2001 | Rashid et al. | |
| 6,505,492 | B2 * | 1/2003 | Jroski | 72/348 |
| 6,581,428 | B1 | 6/2003 | Friedman | |
| 6,613,164 | B2 * | 9/2003 | Dykstra et al. | 72/62 |
| 6,615,631 | B2 | 9/2003 | Kleber et al. | |
| 6,672,121 | B2 | 1/2004 | Carsley et al. | |
| 6,910,358 | B2 * | 6/2005 | Schroth | 72/342.7 |
| 7,028,519 | B2 * | 4/2006 | Kim et al. | 72/60 |
| 2004/0074273 | A1 | 4/2004 | Kin et al. | |
| 2004/0083784 | A1 | 5/2004 | Kim et al. | |
| 2005/0150266 | A1 | 6/2005 | Kruger et al. | |

FOREIGN PATENT DOCUMENTS

| | | |
|---|---|---|
| EP | 1410856 | 4/2004 |
| EP | 1508400 | 2/2005 |

* cited by examiner

*Primary Examiner*—David B Jones
(74) *Attorney, Agent, or Firm*—Tung & Associates; Raymond L. Coppiellie

(57) ABSTRACT

A sheet metal forming process and apparatus using both a mechanical forming step and a superplastic forming step. The mechanical forming step includes using a double-action draw die to create a preform. The preform is then transferred to a superplastic forming tool that uses a superplastic forming process to complete the forming process and create a finished workpiece. Using the mechanical forming step enables rapid creation of a preform having a geometry that reduces overall forming time and provides the ability to draw in additional material to reduce part thinning.

20 Claims, 4 Drawing Sheets

SHEET METAL FORMING PROCESS

CROSS-REFERENCE TO RELATED APPLICATIONS

Not Applicable.

BACKGROUND OF THE INVENTION

1. Field of the Invention

The present invention relates generally to material forming; and more particularly, to a method for forming a metal sheet.

2. Description of Related Art

Various methods are known for forming a metal sheet. One method involves a draw process wherein a punch pulls a portion of the metal sheet through a shaped die. During the process, the metal sheet typically undergoes a reduction or change in the cross-sectional area or wall thickness of the sheet. Such processes are typically limited by the material's ability to be strained past its rupture point. Thus, depending upon the complexity of the part, the forming stresses on the metal sheet during the forming process may result in metal failure or fatigue and correspondingly an unusable or scrap part.

Superplastic forming (SPF) is a process that takes advantage of a material's superplasticity or ability to be strained past its rupture point under certain elevated temperature conditions. Superplasticity in metals is defined by very high tensile elongation and is the ability of certain materials to undergo extreme elongation at proper temperature and strain rate. SPF is a process used to produce parts that are difficult to form using conventional fabrication techniques.

During the superplastic forming process, the metal sheet, or as often referred to the blank, is heated to a point of superplasticity after which a predefined gas pressure is applied to one side of the sheet. The pressure forces the sheet into a die cavity while maintaining a target strain rate for deforming the sheet throughout the forming cycle. The superplasticity of the material enables forming of complex components that normally cannot be formed by conventional room temperature metal forming processes. Use of a superplastic forming process enables forming a workpiece with a deep cavity or one formed over very small radii. Superplastic forming does have a disadvantage in that it normally requires relatively long forming cycle times. Specifically, a conventional SPF process used to manufacture a complex part can require a forming cycle time as high as 30 minutes.

Further, superplastic forming cannot always be used to obtain a complex part in a single step and therefore may require two or more forming steps. U.S. Pat. No. 6,581,428 illustrates one method for forming a part that uses a single die capable of preforming both a mechanical draw process and superplastic forming process. The '428 patent utilizes a preforming punch disposed on one of the die members, wherein the punch pre-forms the blank prior to an application of gas pressure to the blank to complete the forming process. While this die structure and corresponding process is well suited to many applications, the die structure is somewhat complex and may not accommodate forming some aspects of a complex part such as small radii and corners without causing wrinkling during the drawing process.

In addition, such die sets can be somewhat expensive, relatively complex and in some instances, suitable material from the binder area may not be pulled into the die during the draw process. Accordingly, there exists a need for a process for forming metal sheets or blanks that reduces the complexity of the die components while making use of both mechanical and superplastic forming processes.

SUMMARY OF THE INVENTION

The present invention is a method for forming a workpiece, typically a metal sheet or blank. The method includes a multistage hot metal forming operation wherein the metal sheet or blank undergoes a first, pre-forming stage prior to undergoing a second, gas pressure or superplastic forming stage. The method includes a double-action hot draw die used to create a preform. Once created, the preform is mechanically or manually transferred to a conventional single-sided superplastic forming tool that forms the final part geometry utilizing a superplastic forming process.

The method includes developing a preform geometry that reduces forming time and improves panel mobility during the gas or superplastic forming cycle by improving the forming aspect ratio, requiring less part or metal stretch to form over small radii and the ability to draw additional material from the binder area to reduce the amount of thinning required to form the part.

DETAILED DESCRIPTION OF THE PREFERRED EMBODIMENTS

Figures 1, 2, 3:
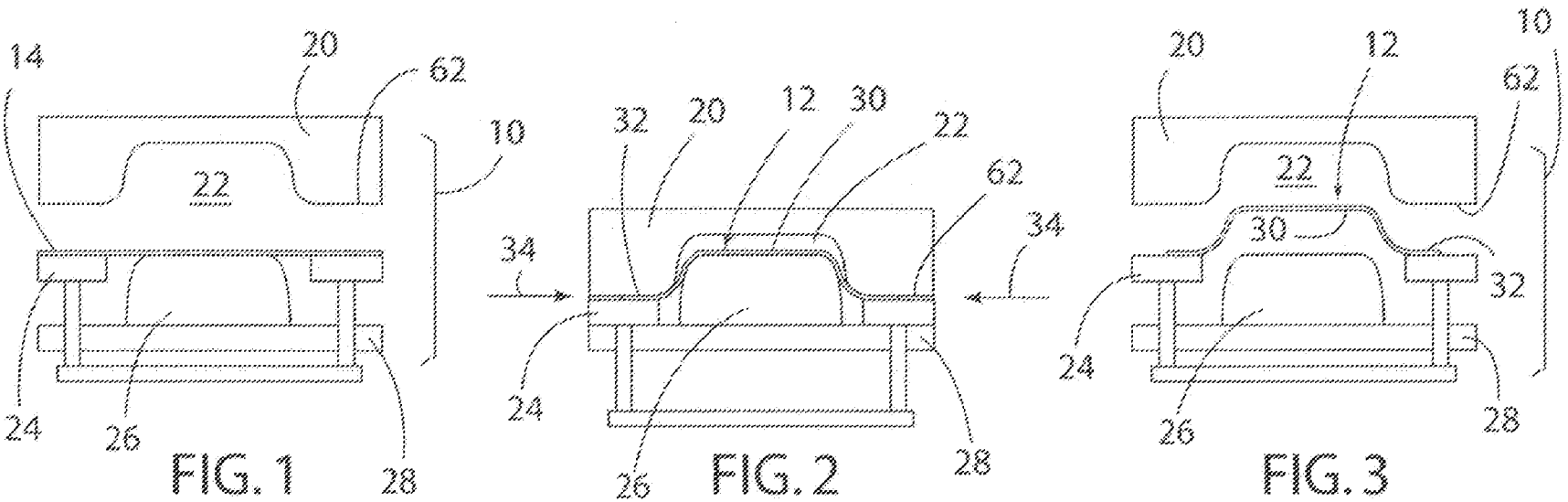
FIG. 1 is a schematic view of a step of one embodiment of the process according to the present invention illustrating the step of loading a blank into a double-action draw die.
FIG. 2 is a schematic view of an additional step of one embodiment of the process according to the present invention illustrating the step of utilizing the double-action draw die to create a preform.
FIG. 3 is a schematic view of an additional step of one embodiment of the process according to the present invention illustrating the step of removing the preform from the double-action draw die.

Referring now to the drawings, FIGS. 1-3 schematically illustrate a double-action draw die 10 used to create a preform 12 from a blank 14 according to a first stage of the present invention. FIGS. 4-7 schematically illustrate a second stage of the present invention using a superplastic forming tool 40 to complete the forming process on the preform 12 to create a finished workpiece 18. Typically, the process of the present invention is utilized with a blank 14 made of a lightweight sheet material, including a sheet of material formed of various aluminum and magnesium alloys. As shown in FIG. 1, the draw die 10 includes an upper die member 20 having a die cavity 22, a blank holder 24 and a punch 26 located on a lower die platen or member 28. Prior to beginning the forming process the draw die 10 is placed in a dual or double-action press (not shown) that operates to move the blank holder 24 independent of the punch 26.

A first step in the forming process is to place or load the blank 14 into the draw die 10. According to one embodiment of the present invention, the blank 14 is heated to a suitable forming temperature, typically the superplastic forming temperature of the particular material, prior to being loaded into the draw die 10. Preheating the blank 14 may be accomplished by a variety of methods, including a preheat assembly having upper and lower platens that contact and heat the blank 14. In addition, heated press platens or heaters embedded within the draw die 10 operate to heat the draw die 10 to the superplastic forming temperature of the blank 14. Such preheat and heating assemblies for use with a superplastic forming tool are known to individuals of skill in the art.

The blank 14 and corresponding draw die 10 are heated to the superplastic forming temperature of the blank material since the blank 14 ultimately undergoes a superplastic forming step in the second stage of the forming process. By preheating the blank 14 prior to undergoing the first stage of the process, the preform 12 is already at a superplastic forming temperature and is therefore ready to undergo the second stage of the process thereby eliminating any wait time necessary to heat the preform 12. Eliminating wait time correspondingly decreases the overall forming time necessary to form the finished workpiece 18.

As illustrated in FIG. 2 the draw die 10 operates such that the punch 26 forces the blank 14 into the die cavity 22 to form the preform 12 with minimal thinning of blank 14. The preform 12 includes two portions generally referred to as the cup 30 and flange 32. During the draw process, punch 26 cooperates with the die cavity 22 to draw the ends of the blank 14 inward in the direction of the arrows 34. The circumferential stresses occurring during the draw process make the flange 32 the critical region of the preform 12. In order to prevent wrinkling of the flange 32 and control the process, the blank holder 24 applies pressure to the flange 32 to suppress wrinkling and control material draw into the die cavity 22. During operation of a double-action die, the blank holder 24 functions independently of the punch 26 whereby the blank holder 24 secures the periphery of the blank 14 to control the amount of material of the blank 14 drawn into the die cavity 22.

Figure 4:
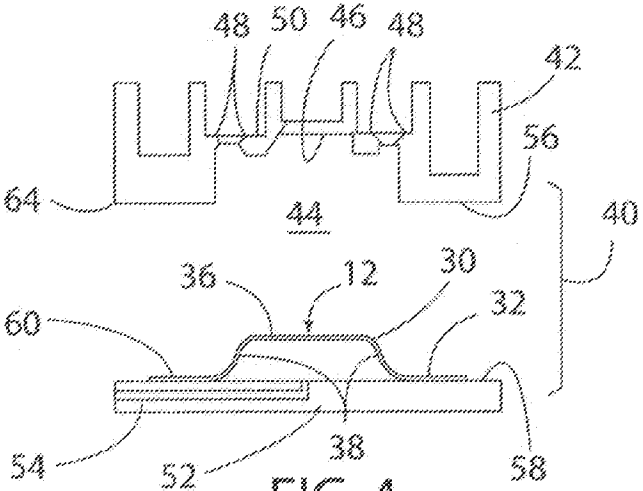
FIG. 4 is a schematic view of an additional step of one embodiment of the process according to the present invention illustrating the step of placing the preform in a superplastic forming die.

As illustrated in FIG. 3, once the draw process is complete, the preform 12, still at a superplastic forming temperature, is removed from the draw die 10 and transferred to the superplastic forming tool 40. Accordingly, the draw process, as illustrated in FIGS. 1-3, enables a general shaping of the preform 12 with the ability to draw additional material into the die cavity 22 to reduce the thinning effect on the preform 12 occurring during the superplastic forming process. Thus, depending upon the particular geometry of the finished workpiece, a specific draw die 10 having a predetermined punch 26 and die cavity 22 configuration creates a preform 12 with a thickness profile suited to superplastic forming step occurring during the second stage of the process. For example, the base 36 of the cup 30 may have a greater thickness than that of the sidewalls 38. In addition, varying the pressure applied by the blank holder 24 on the flange 32 enables an operator to vary the design and corresponding thickness profile of the preform 12. While FIG. 4 shows the preform 12 of the disclosed embodiment as having a generally cup-shaped configuration 30, with a base 36, sidewalls 38 and a flange 32, this is for illustrative purposes only and a plurality of complex configurations can be formed during the first, preform stage. Depending upon the ultimate configuration of the workpiece 18 formed from the blank 14, the first, preform stage utilizes the draw die 10 to distribute material and create the preform 12 in a predetermined or preconfigured profile suited for the second, superplastic forming stage used to complete the process and form the workpiece 18 in the desired configuration.

As illustrated in FIG. 4, the preform 12 is placed in a superplastic forming tool 40. The superplastic forming tool 40 is either self-heated by heater elements located within the tool 40 or heated by contact/conduction with heated die platens located in a press assembly. The superplastic forming tool 40 includes an upper die member 42 including a mold cavity 44 having a mold surface 46. A plurality of passageways 48 located in the upper die member 42 extend from the mold cavity 44 to the rear or outer surface 50 of the upper die member 42. Depending upon the geometry of the cavity 44 and corresponding mold surface 46, multiple passageways 48 may be located in the upper die member 42. The superplastic forming tool 40 further includes a lower die member 52 having a passageway 54 for delivering gas or fluid at a predetermined pressure to the mold cavity 44. The upper die member 50 includes an upper seal surface 56 and the lower die member 52 includes a lower seal surface 58. When the upper die member 50 and lower die member 52 are placed in a closed position, the respective upper and lower seal surfaces 56, 58 engage the flange portion 32 of the preform 12 to seal the preform 12 within the superplastic forming tool 40 such that the pressurized gas or fluid entering the mold cavity 44 through the passageway 54 acts on the preform 14.

It should be understood that the flange 32 of the preform 14 need not be a planar surface. For an example, the ultimate configuration of the preform 12 includes a flange 32 having a complex curvature, see FIGS. 8-10. Accordingly, the respective seal surfaces 56, 58 of the upper die member 42 and the lower die member 52 are configured such that they engage flange 32 and form a seal at or near the periphery 60 thereof. As used herein, the term periphery refers to the region or zone adjacent an outer edge. Accordingly, it should be understood that the configuration of the periphery 62 of the draw die 10 and the periphery 64 of the superplastic forming tool 40 have a similar configuration.

Figure 5:
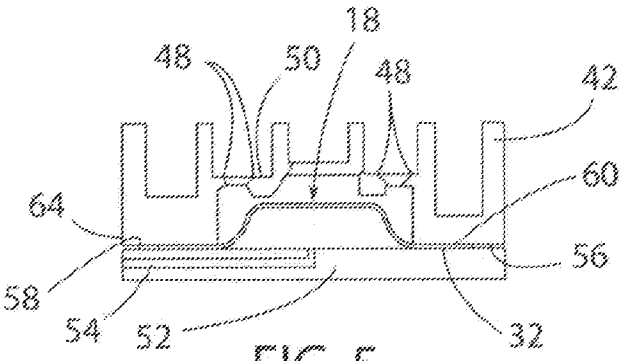
FIG. 5 is a schematic view of an additional step of one embodiment of the process according to the present invention illustrating the step of closing the superplastic forming die.

As illustrated in FIG. 5 once the heated preform 12 is placed in the superplastic forming tool 40, the respective upper die member and lower die member 52 are closed forming a seal about the peripherally 60 of the flange 32.

Figure 7:
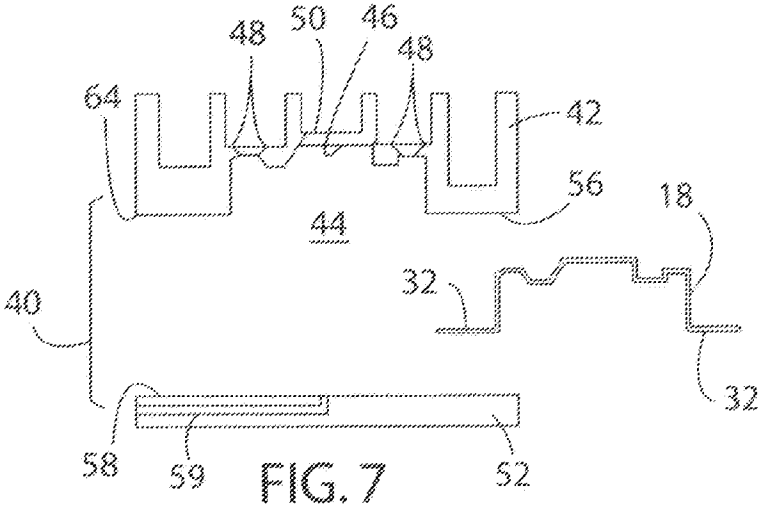
FIG. 7 is a schematic view of an additional step of one embodiment of the process according to the present invention illustrating the step of removing the workpiece from the superplastic forming die.
Figure 6:
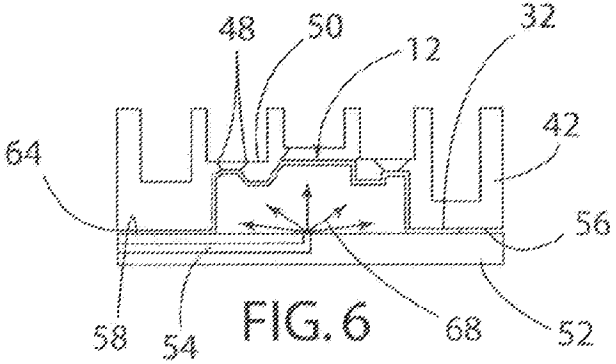
FIG. 6 is a schematic view of an additional step of one embodiment of the process according to the present invention illustrating the step of using superplastic forming to complete the process and form the finished workpiece.

FIG. 6 illustrates the next step of supplying gas or fluid pressure through passageway 54 in the lower die member 52 to increase the pressure in the mold cavity 44 on one side of the preform 14. Increasing the pressure in the mold cavity 44 drives the preform 12 in the direction of the arrows 68 towards and ultimately against the mold surface 46 of the upper die member 42. As the preform 12 moves toward and ultimately contacts the mold surface 46, any pressure or gas buildup between the preform 12 and the upper die member 42 is vented through the passageways 48 to the atmosphere. FIG. 7 illustrates opening the superplastic forming tool 40 and removing the completely formed workpiece 18 from the superplastic forming tool 40 upon completion of the superplastic forming process.

Figure 8:
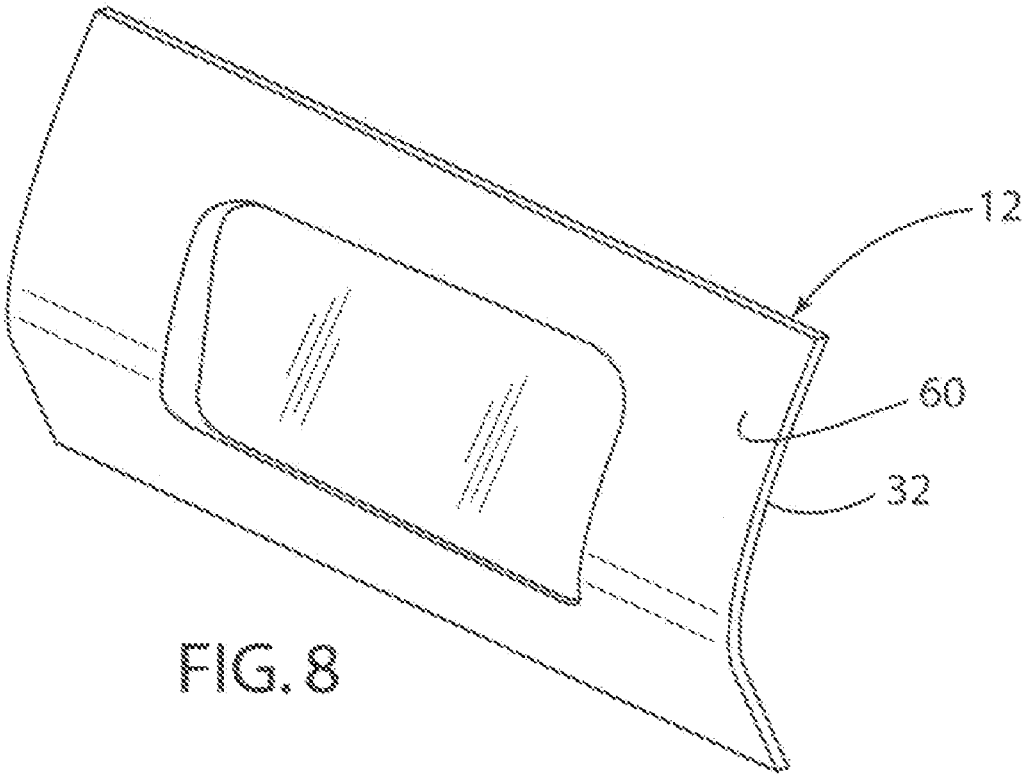
FIG. 8 is a perspective view of a preform prior to undergoing the superplastic forming process or stage of the present invention.
Figure 10:
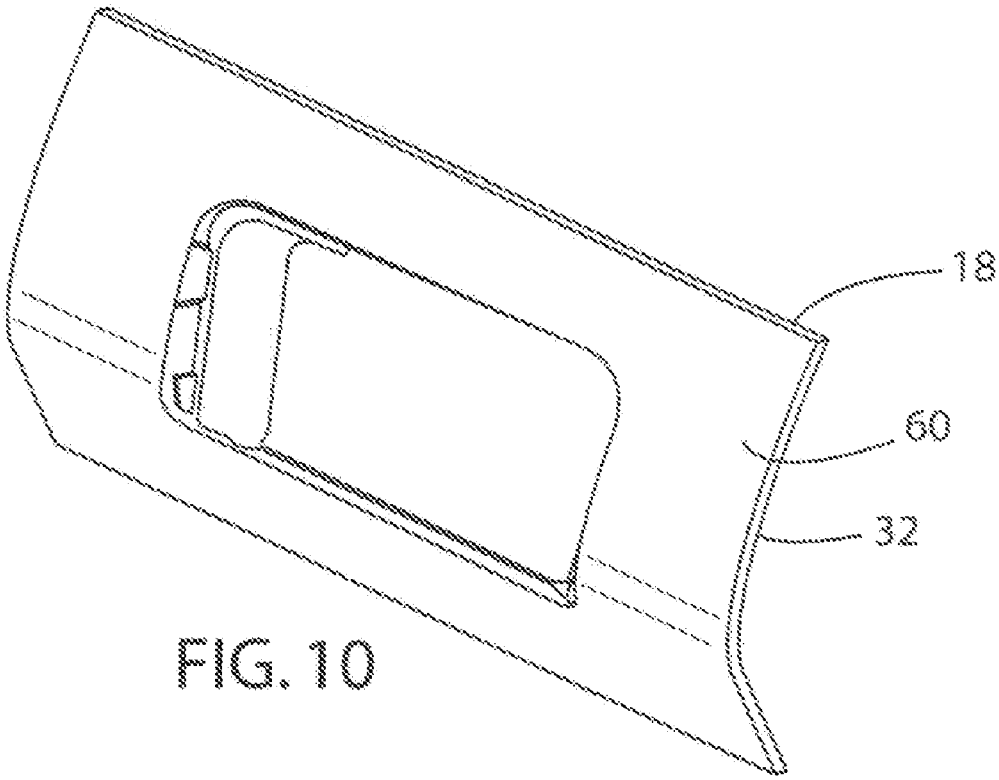
FIG. 10 is a perspective view of a finished workpiece formed using the method of the present invention.
Figure 9:
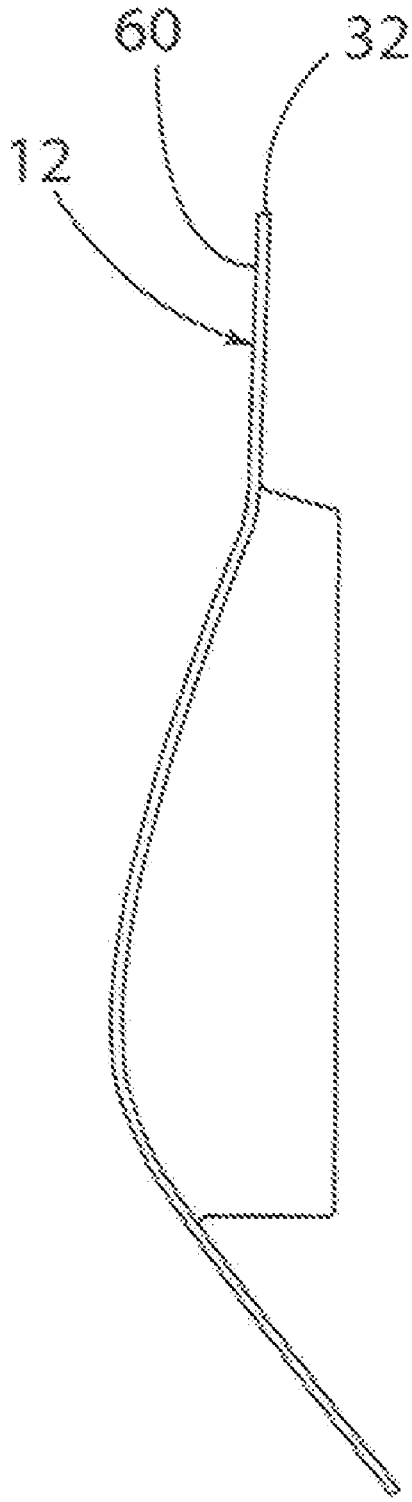
FIG. 9 is a side view of the preform of FIG. 8.

FIGS. 8-10 show an illustrative example of a preform 12 and a workpiece 18 formed in accordance with the process of the present invention. As shown, the preform 12 and workpiece 18 both have a flange 32 having a complementary periphery 60. As illustrated, the flange 32 as a curved configuration imparted to the flange 32 during the initial mechanical pre-form process. Accordingly, the mechanical forming step takes advantage of a faster forming operation to create the preform 12. Having a complementary periphery 60 configuration enables removal of the preform 12 from the draw die 10 and immediate placement in the superplastic forming tool 40 without an extra step or need to reshape the flange 32 created during the draw stage of the process. In this manner, the flange 32 forms a binder surface suitable for use during the superplastic forming stage of the process. Accordingly, the superplastic forming tool 40 may have complementary non-planar seal surfaces formed on the periphery 64 of each of the upper die member 42 and the lower die member 52. When the respective upper die member 42 and lower die member 52 close together on the flange 32 of the preform 12 they sandwich the flange 32 of the preform 12 between them and form the seal needed to complete the superplastic forming process.

The present invention provides for a preform 12 design that makes use of the advantages of the draw die 10 to rapidly create a heated preform in a predetermined configuration. By making the preform 12 in a predetermined configuration, the advantages of a conventional superplastic forming process, such as forming of complex components that require drawing metal over a very small radii or forming deep cavities are now available in a single step at a reduced cycle time. As disclosed herein, the preform 12 may take a multitude of shapes including a non-planar flange or binder.

The preform 12 is manually or mechanically transferred from the draw die 10 to the superplastic forming tool 40 wherein the final workpiece 18 is formed using a superplastic forming process. As set forth above, the preform 12 geometry or configuration is engineered to reduce forming time and to improve formability during the superplastic forming cycle by improving gas forming aspect ratios, requiring less stretch to form over radii and drawing additional material from the binder area to reduce the amount of thinning required to form the workpiece 18. In addition, the preform 12 is formed in a hot draw die 10 such that the flow stress of the material during the draw process is very low which, substantially reduces the load requirements on the press ram and cushion system. Subsequently the draw die 10 can be constructed from lower strength material. It should be understood that the present invention provides for a process whereby deep draw components, such as inner door panels for automotive vehicles made from an aluminum or magnesium alloy, can be manufactured at a reduced cycle time over conventional superplastic forming processes. The disclosed process may also take advantage of the fact that both the draw die 10 and superplastic forming tool 40 can be placed in the same press whereby the heated press platens heat, through conductivity, both the draw die 10 and the superplastic forming tool 40.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A process for forming a workpiece comprising the steps of:

heating the workpiece to a superplastic forming temperature;

providing a draw die having and upper die member and a lower die member, at least one of said die members including a punch and the opposite die member having a die cavity, the draw die further including a blank holder;

placing the heated workpiece in the draw die between the upper and lower die members and forming a preform by drawing at least a portion of the workpiece into the die cavity wherein the preform includes a cup portion and a flange portion;

using the draw die to distribute the material of the workpiece and create the preform in a preconfigured shape;

providing a superplastic forming tool having an upper die member and a lower die member with one of said upper die member and said lower die member having a mold cavity including a mold surface;

removing the preform from the draw die and placing the preform in the superplastic forming tool such that the can portion of the preform is located in the mold cavity of the lower die member of the superplastic forming tool;

closing the superplastic forming tool by bringing the upper die member and lower die member into contact with the preform whereby the preform is sandwiched between the upper die member and lower die member thereby creating a seal about the peripheral edge of the preform;

applying gas pressure to one side of the preform to drive the workpiece against the mold surface of the mold cavity to complete the forming process.

2. The process for forming a workpiece as set forth in claim 1 wherein the step of using the draw die to distribute the material of the workpiece and create the preform in a preconfigured shape includes including the step of using the blank holder to control the rate and amount of material draw into the die cavity.

3. The process for forming a workpiece as set forth in claim 1 including the step of using the blank holder to control wrinkling of the blank during the draw process.

4. The process for forming a workpiece as set forth in claim 1 wherein the step of forming the preform includes the step of using the blank holder to form the preform with the flange portion having a non-planar configuration.

5. The process for forming a workpiece as set forth in claim 1 wherein the step of forming the preform includes the step of utilizing the draw die to form the flange portion of the preform such that the flange portion has a non-planar configuration.

6. The process for forming a workpiece as set forth in claim 5 wherein the step of forming the preform such that the flange portion of the preform has a non-planar configuration includes utilizing the blank holder and at least one of the die members of the draw die to form the non-planar configuration.

7. The process for forming a workpiece as set forth in claim 1 including the step of providing the upper die member and lower die member of the forming tool with a non-planar configuration like the non-planar configuration of the preform such that the preform fits between the upper and lower die members of the forming tool wherein when the forming tool is closed the upper and lower die member engage the preform and form a seal without substantially deforming the non-planar configuration of the preform.

8. The process for forming a workpiece as set forth in claim 1 wherein the superplastic forming tool has a non-planar seal surface, and the preform includes a flange portion that engages the seal surface of the superplastic forming tool, the flange portion having a non-planar configuration, the non-planar configuration of the flange portion like the non-planar seal surface of the superplastic forming tool.

9. The process for forming a workpiece as set forth in claim 8 wherein the step of forming a preform by drawing at least a portion of the workpiece into the die cavity includes shaping at least a portion of the preform such that it has a predetermined configuration wherein the thickness of the preform varies at various locations along the profile.

10. The process for forming a workpiece as set forth in claim 1 including the step of locating both the draw die and the superplastic forming tool in the same press and using the press to operate both the draw die and the superplastic forming tool.

11. An apparatus for forming a workpiece comprising:

a draw die having an upper die member and a lower die member, at least one of said die members including a punch and the other die member having a die cavity, the draw die further including a blank holder; said blank holder having a mating surface located on a periphery thereof, said mating surface having a non-planar configuration that corresponds to a non-planar configuration on a periphery of the die member having the die cavity;

a superplastic forming tool having an upper die member and a lower die member, said upper die member having a mating surface located on a periphery thereof and said lower die member having a mating surface located on a periphery thereof, said mating surface of said upper die member having a non-planar configuration and said mating surface of said lower die member having a non-planer configuration, said lower die member having a mold cavity including a mold surface; said die members operate to move between a first open position and a second closed position wherein said workpiece is sandwiched between said upper die member and said lower die member such that said mold cavity is sealed to prevent fluid passage between said upper and lower die members; and a passageway extending through at least one of said upper die member and lower die member to said mold cavity, said passageway operative to allow passage of fluid into said mold cavity.

12. An apparatus for forming a workpiece as set forth in claim 11 including at least one passageway in both said upper die member and said lower die member, each of said passageways communicating with said mold cavity.

13. An apparatus for forming a workpiece 11 wherein said non-planar configuration of said mating surfaces of said draw die and said non-planar configuration of said superplastic forming tool are substantially similar.

14. An apparatus for forming a workpiece as set forth in claim 11 wherein said draw die is a double-action die operative to create a preform having a non-planar periphery.

15. An apparatus for forming a workpiece as set forth in claim 11 wherein said blank holder contacts said workpiece during the draw process and controls material flow into said die cavity.

16. An apparatus for forming a workpiece as set forth in claim 11 including said blank holder mounted for movement independent of said punch.

17. A process for forming a workpiece comprising the steps of:

hot drawing a preform from a blank, including the steps of loading a hot blank into a draw die, performing a draw process on the blank and removing the hot preform from the draw die;

using the draw process to create a preform profile by distributing material of the blank in a predetermined configuration wherein the thickness of the preform varies at various locations along the profile; and subjecting the hot preform to a superplastic forming step, including transferring the hot preform from the draw die to a superplastic forming die and positioning the hot preform within the superplastic forming die in preparation for superplastic forming, closing said die and supplying pressurized gas to a mold cavity in said superplastic forming die to drive at least a portion of the hot preform against a mold surface of the superplastic forming die to complete the forming process and removing the completed workpiece from the superplastic forming die.

18. A process for forming a workpiece as set forth in claim 17 including the step of using a blank holder in connection with the draw die to control the amount of blank material drawn into a die cavity of the draw die.

19. A process for forming a workpiece as set forth in claim 17 including the step of using the blank holder to create a preform having a periphery having a non-planar configuration.

20. A process for forming a workpiece as set forth in claim 17 wherein the step of using the draw process to create a preform profile wherein the thickness of the preform varies at various locations along the profile includes the step of configuring the preform based on a preconfigured profile suited for the superplastic forming stage.

* * * * *